US008079734B2

(12) United States Patent
Hou

(10) Patent No.: US 8,079,734 B2
(45) Date of Patent: Dec. 20, 2011

(54) LIGHTING DEVICE

(75) Inventor: Sheng-Fa Hou, Hsinchu (TW)

(73) Assignee: Lite-On IT Corporation, Taipei (TW)

( * ) Notice: Subject to any disclaimer, the term of this patent is extended or adjusted under 35 U.S.C. 154(b) by 288 days.

(21) Appl. No.: 12/540,690

(22) Filed: Aug. 13, 2009

(65) Prior Publication Data

US 2011/0038161 A1 Feb. 17, 2011

(51) Int. Cl.
*F21V 5/02* (2006.01)

(52) U.S. Cl. ..... 362/281; 362/326; 362/331; 362/332; 362/337; 362/339

(58) Field of Classification Search ..... 362/281, 362/326, 337, 339, 340, 331, 332
See application file for complete search history.

(56) References Cited

U.S. PATENT DOCUMENTS 5,191,485 A * 3/1993 Kahle ..... 359/834
7,338,187 B2 * 3/2008 Li ..... 362/297
7,354,179 B2 * 4/2008 Huang et al. ..... 362/337
7,845,834 B2 * 12/2010 Hou ..... 362/331
2002/0085276 A1 * 7/2002 Tanitsu et al. ..... 359/432

* cited by examiner

*Primary Examiner* — Stephen F Husar
*Assistant Examiner* — James Cranson, Jr.
(74) *Attorney, Agent, or Firm* — Thomas, Kayden, Horstemeyer & Risley, LLP

(57) ABSTRACT

A lighting device includes a light source, first and second beam-directing prism elements, and a transmission device. The light source emits a light beam. The first beam-directing prism element is arranged in a first direction. The second beam-directing prism element is arranged in a second direction and partially overlapped with the first beam-directing prism element. When the light beam passes through different regions of the first and second beam-directing prism elements, different bending angles are resulted. The transmission device is connected to the first and second beam-directing prism elements for driving movement of the first beam-directing prism element in the first direction and movement of the second beam-directing prism element in the second direction. Accordingly, the light beam emitted by the light source simultaneously passes through one of the regions of the first beam-directing prism element and one of the regions of the second beam-directing prism element.

13 Claims, 8 Drawing Sheets

LIGHTING DEVICE

FIELD OF THE INVENTION

The present invention relates to a lighting device, and more particularly to a lighting device for providing continuous illumination variation.

BACKGROUND OF THE INVENTION

Lighting devices such as lamps or bulbs are designed to produce light from electricity. With rapid development of industrial techniques, these lighting devices become essential components in our daily lives because they can improve the living quality. In the early stage, lighting devices are used for simply providing a bright place. With diversified living attitudes, in addition to the illuminating purpose, proper lighting devices can enhance task performance or aesthetics. For complying with various demands, the lighting devices should be designed to have desired sizes or produce light with desired irradiation position, orientation, inclination or intensity.

For example, especially for the large-scale stage designs or small-scale cabin illumination systems, it is very important to adjust the orientation and inclination of incident light. Conventionally, there are two types of mechanisms for adjusting the orientation and inclination of incident light. These three mechanisms are designed according to the configurations, light sources or light path switching structures.

FIG. 1 is a schematic diagram illustrating a first type lighting device for adjusting the orientation and inclination of incident light. Such a lighting device is disclosed in for example U.S. Pat. No. 5,690,417, and the contents of which are hereby incorporated by reference. As shown in FIG. 1, the lighting device 10 principally comprises a light source group 11. The light source group 11 comprises a plurality of lamps. These lamps can be inclined at different angles so as to adjust the orientation and inclination of incident light. As a consequence, the light beams emitted by the lamps can be selectively directed to a workpiece 13 on a work table 12. This lighting device, however, still has some drawbacks. For example, a great amount of light sources are required in this lighting device 10. In addition, the control system for this lighting device 10 is very complicated. In a case that the lamps are selectively turned on and turned off while changing orientation and inclination of incident light, discontinuous illumination will possibly occur.

FIG. 2 is a schematic diagram illustrating a second type lighting device for adjusting the orientation and inclination of incident light. Such a lighting device is disclosed in for example U.S. Pat. Nos. 3,912,918, 5,070,434 and 6,461,024, and the contents of which are hereby incorporated by reference. For reducing the overall volume and saving the fabricating cost, the orientation and inclination of incident light for the lighting device 30 are manually controlled. A light source is mounted inside a casing 31 and a cone member 32. The casing 31 may be fixed or supported by a specified apparatus. A shaft 34 is secured to a ball assembly 33. By rotating the ball assembly 33, the cone member 32 is adjusted to a desired position as shown in dotted line such that orientation and inclination of incident light are adjustable. This lighting device 30 is applicable to cabin illumination systems or other small-scale illumination systems. The manual operation of such a lighting device is not convenient. In addition, it is labor-intensive to rotate the cone member and the ball assembly.

Therefore, there is a need of providing an improved lighting device and a method of operating such a lighting device to obviate the drawbacks encountered from the prior art.

SUMMARY OF THE INVENTION

In accordance with an aspect of the present invention, there is provided a lighting device. The lighting device includes a light source, a first beam-directing prism element, a second beam-directing prism element and a transmission device. The light source emits a light beam. The first beam-directing prism element is arranged in a first direction, wherein different bending angles are resulted when the light beam passes through different regions of the first beam-directing prism element. The second beam-directing prism element is arranged in a second direction and partially overlapped with the first beam-directing prism element, wherein different bending angles are resulted when the light beam passes through different regions of the second beam-directing prism element. The transmission device is connected to the first beam-directing prism element and the second beam-directing prism element for driving movement of the first beam-directing prism element in the first direction and movement of the second beam-directing prism element in the second direction. Accordingly, the light beam emitted by the light source simultaneously passes through one of the regions of the first beam-directing prism element and one of the regions of the second beam-directing prism element.

In accordance with another aspect of the present invention, there is provided a lighting device. The lighting device includes a light source, a first ring-shaped beam-directing prism element, a second ring-shaped beam-directing prism element and a transmission device. The light source emits a light beam. When the light beam passes through different regions of the first ring-shaped-directing prism element, different bending angles are resulted. The second ring-shaped-directing prism element is partially overlapped with the first ring-shaped-directing prism element. When the light beam passes through different regions of the second ring-shaped-directing prism element, different bending angles are resulted. The transmission device is connected to the first ring-shaped-directing prism element and the second ring-shaped-directing prism element for driving rotation of the first ring-shaped-directing prism element and the second ring-shaped-directing prism element. Accordingly, the light beam emitted by the light source simultaneously passes through one of the regions of the first ring-shaped-directing prism element and one of the regions of the second ring-shaped-directing prism element.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
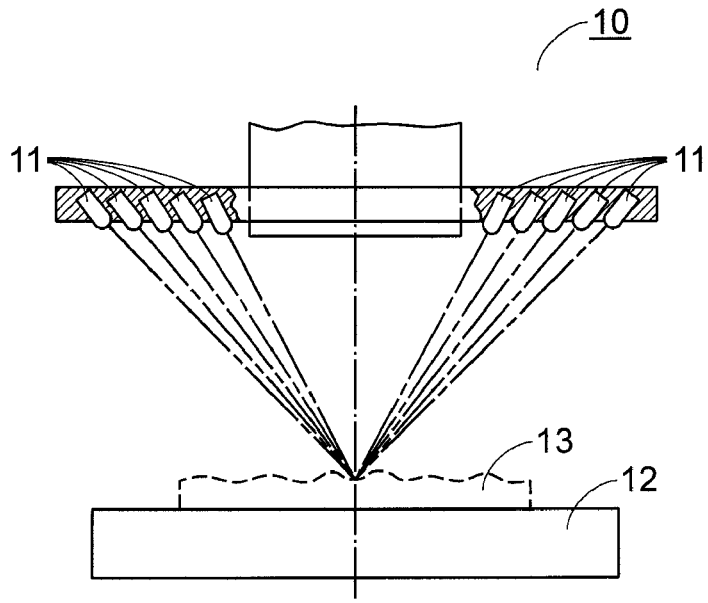
FIG.1 PRIOR ART
FIG. 1 is a schematic diagram illustrating a first type lighting device for adjusting the orientation and inclination of incident light according to the prior art.
Figure 2:
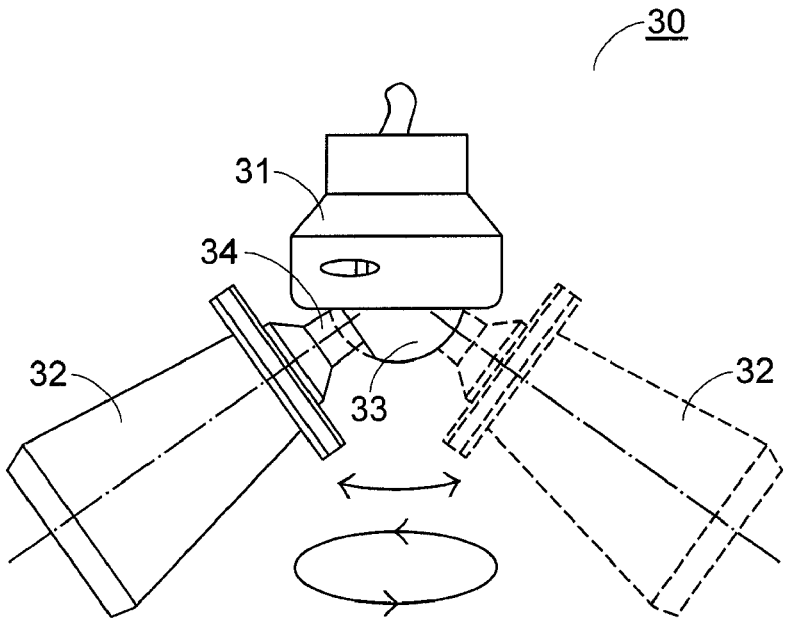
FIG.2 PRIOR ART
FIG. 2 is a schematic diagram illustrating a second type lighting device for adjusting the orientation and inclination of incident light according to the prior art.
Figure 3A:
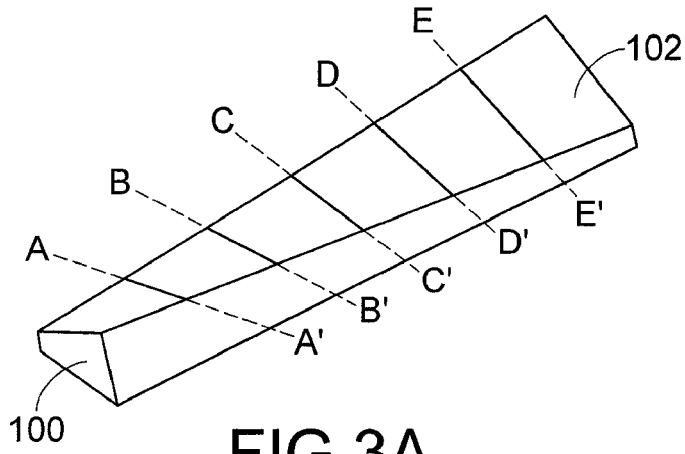
FIG. 3A is a schematic perspective view illustrating an exemplary beam-directing prism element used in a lighting device of the present invention.

FIG. 3A is a schematic perspective view illustrating an exemplary beam-directing prism element of a lighting device according to the present invention. The beam-directing prism element 100 is made of transparent material such as polymethylmethacrylate (PMMA) or polycarbonate (PC). In accordance with a key feature of the present invention, the beam-directing prism element 100 has a curved surface 102 with gradual slope variations.

Figure 3B:
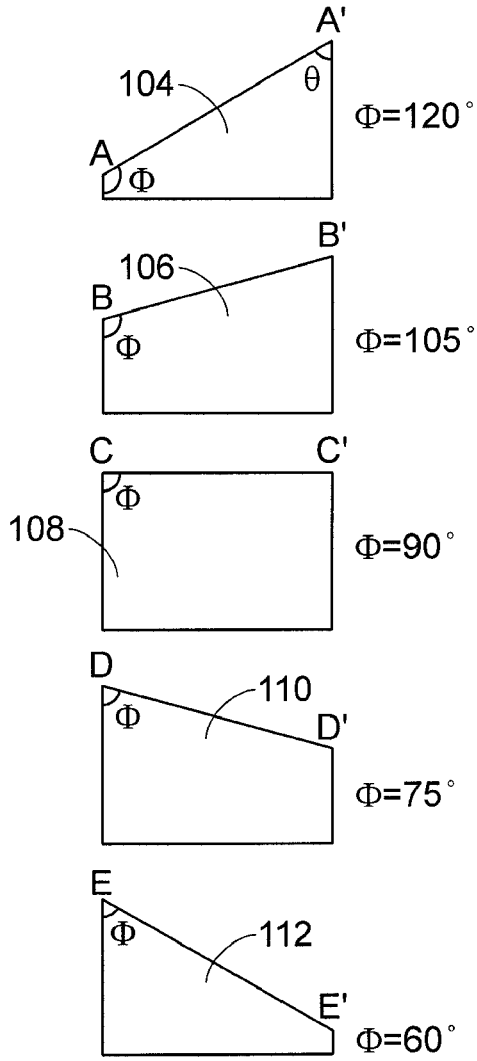
FIG. 3B are schematic views illustrating several cross-sections taken from various positions FIG. 3C are schematic views illustrating light beams diffracted by the beam-directing prism element of FIG. 3A at different prism angles.

FIG. 3B are schematic views illustrating several cross-sections taken from various positions. These cross-sections are quadrilaterals. Each quadrilateral has an angle Φ at the left upper corner and an angle θ at the right upper corner, in which Φ+θ=180°. In this context, the angle Φ is defined as a prism angle. Since the curved surface 102 of the beam-directing prism element 100 has gradual slope variations, the angle Φ and the angle θ are gradually changed in different cross-sections. For example, the cross-section 104 taken from the line AA' has a prism angle of 120°; the cross-section 106 taken from the line BB' has a prism angle of 105°; the cross-section 108 taken from the line CC' has a prism angle of 90°; the cross-section 110 taken from the line DD' has a prism angle of 75°; and the cross-section 112 taken from the line EE' has a prism angle of 60°.

Figure 3C:
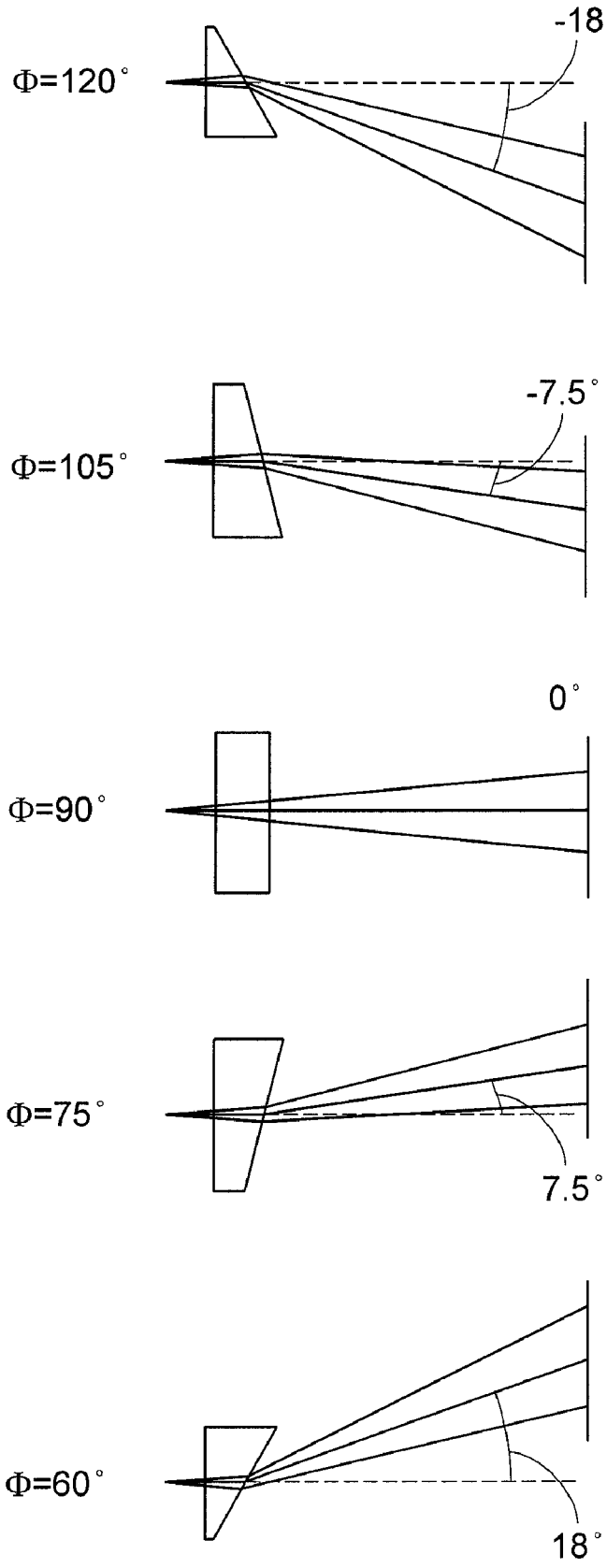

FIG. 3C are schematic views illustrating light beams diffracted by the beam-directing prism element 100 of FIG. 3A at different prism angles. In this embodiment, the beam-directing prism element 100 is made of polymethylmethacrylate (PMMA). If the prism angle Φ is 120°, the beam refraction angle is −18°, i.e. the light beam is downwardly bent by 18°. If the prism angle Φ is 105°, the beam refraction angle is −7.5°, i.e. the light beam is downwardly bent by 7.5°. If the prism angle Φ is 90°, the beam refraction angle is 0°, i.e. the light beam is not bent. If the prism angle Φ is 75°, the beam refraction angle is +7.5°, i.e. the light beam is upwardly bent by 7.5°. If the prism angle Φ is 60°, the beam refraction angle is +18°, i.e. the light beam is upwardly bent by 18°.

Figure 4A:
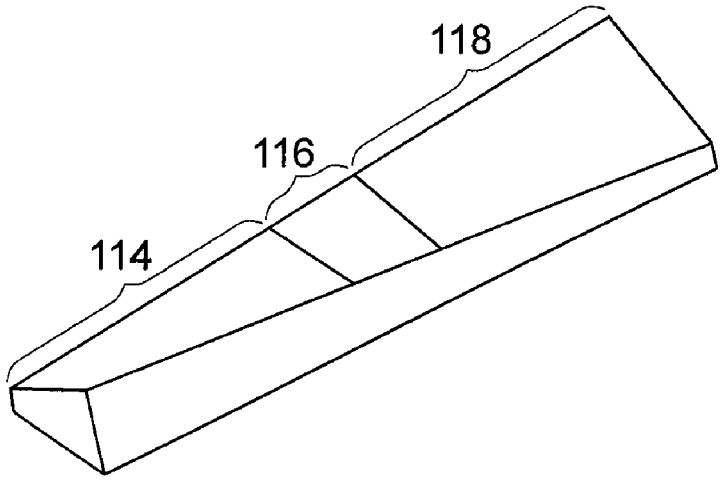
FIG. 4A is a schematic perspective view illustrating a downward directing region, a flat region and an upward directing region of the beam-directing prism element.
Figure 4B:
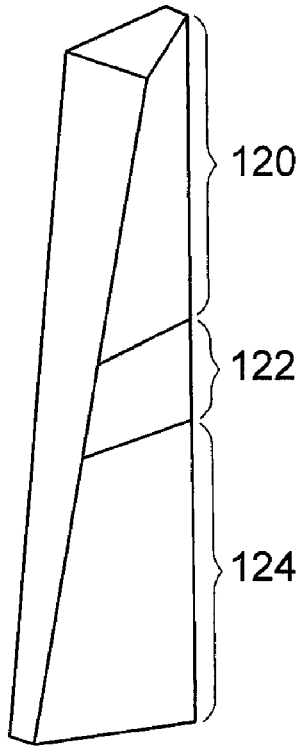
FIG. 4B is a schematic perspective view illustrating a rightward directing region, a flat region and a leftward directing region of the beam-directing prism element.

As shown in FIG. 3C, it is found that the incident light beam is downwardly bent if the prism angle Φ is greater than 90°; the incident light beam is not bent if the prism angle Φ is equal to 90°; and the incident light beam is upwardly bent if the prism angle Φ is smaller than 90°. According to the relation between the prism angle Φ and the bending effect of the beam-directing prism element 100, the beam-directing prism element 100 may be divided into a downward directing region, a flat region and an upward directing region if the prism angle Φ is greater than 90°, equal to 90° and smaller than 90°, respectively. When the beam-directing prism element 100 is horizontally placed on a working plane, as shown in FIG. 4A, the beam-directing prism element 100 has a downward directing region 114 (Φ>90°), a flat region 116 (Φ=90°) and an upward directing region 118 (Φ<90°) from left to right. Similarly, when the beam-directing prism element 100 is vertically placed on a working plane, as shown in FIG. 4B, the beam-directing prism element 100 has a rightward directing region 120 (Φ>90°), a flat region 122 (Φ=90°) and a leftward directing region 124 (Φ<90°) from top to bottom.

Figure 5:
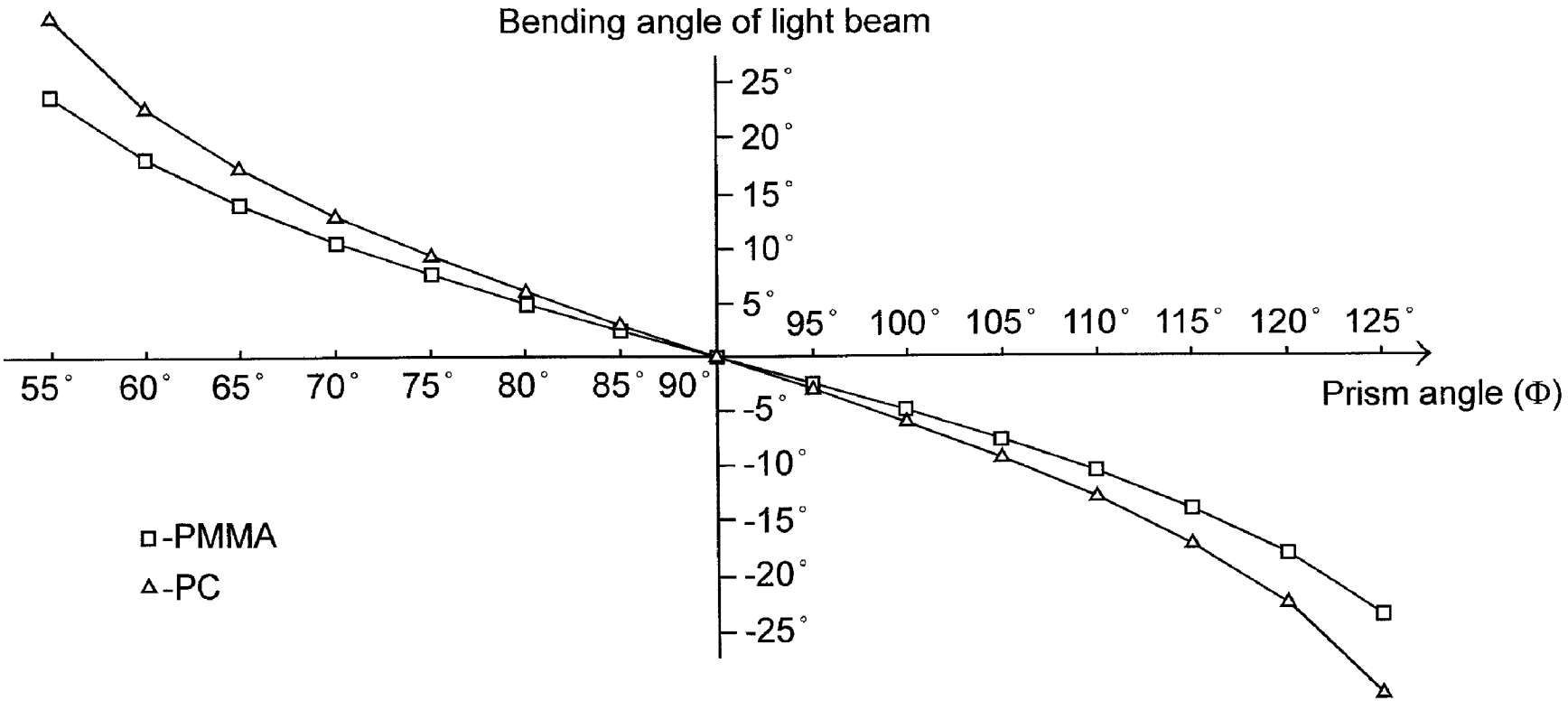
FIG. 5 is a plot diagram illustrating the performance of the beam-directing prism elements made of different materials.

FIG. 5 is a plot diagram illustrating the performance of the beam-directing prism elements made of PMMA (refractive index n=1.49) and PC (refractive index n=1.59) for the prism angle Φ in the range from 55° to 125°. For example, if the beam-directing prism element is made of PC and the prism angle Φ is 105°, the light beam is bent by approximately −10°, wherein the negative sign means that the light beam is bent downwardly. According to the plot diagram shown in FIG. 5, the basic bending amount of the light beam can be changed by using different material of the beam-directing prism elements. It can be seen that the basic bending amount of the light beam by using the beam-directing prism elements made of PMMA is smaller than that by using the beam-directing prism elements made of PC.

Figure 6:
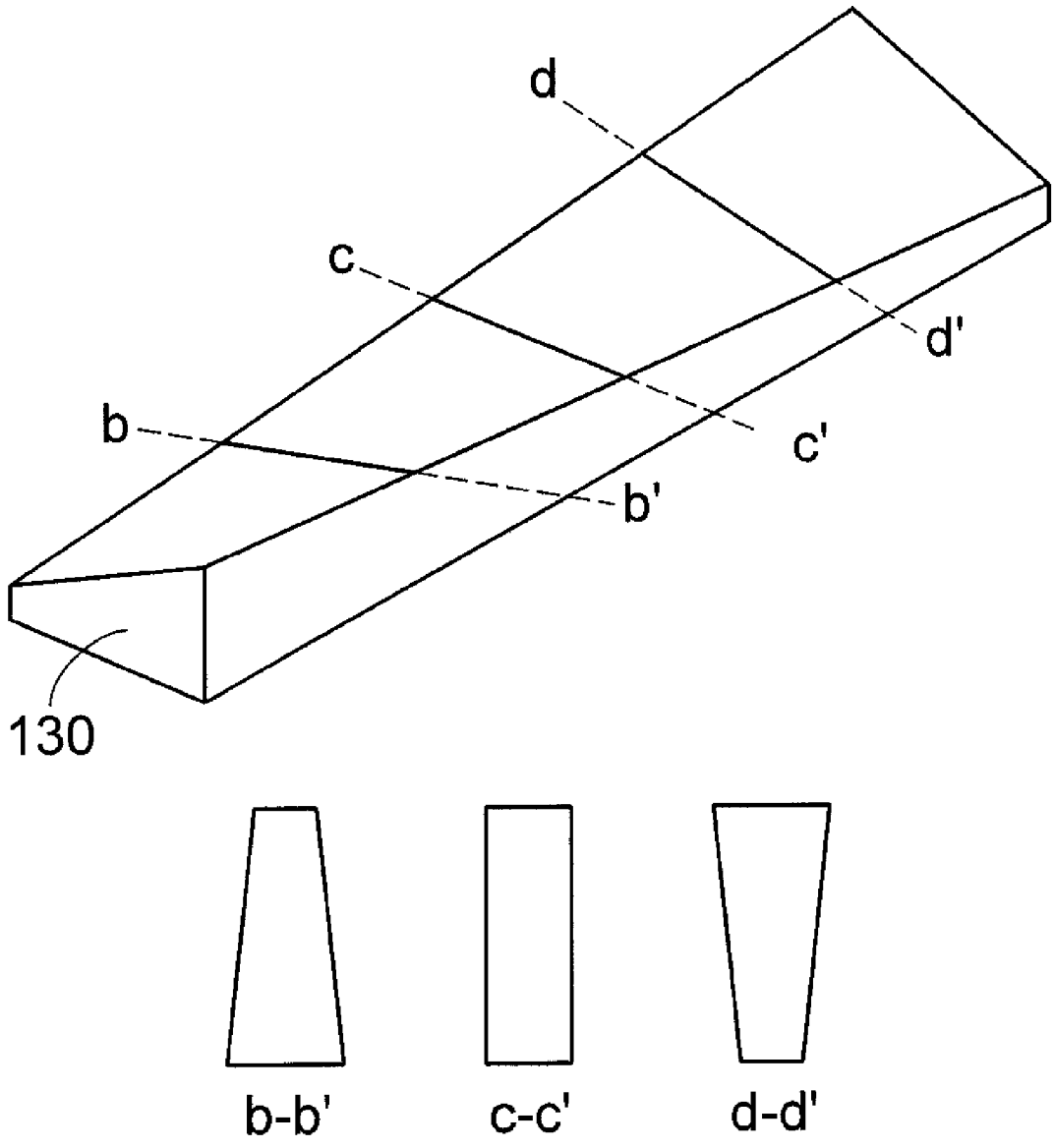
FIG. 6 is a schematic perspective view illustrating another exemplary beam-directing prism element used in a lighting device of the present invention.

In the above embodiment, the beam-directing prism element 100 has a curved surface 102 with gradual slope variations. A further exemplary beam-directing prism element is illustrated in FIG. 6. The beam-directing prism element 130 has two curved surfaces with gradual slope variations. According to the two curved surfaces with gradual slope variations, the basic bending amount and direction of the light beam can be more variable.

Figure 7:
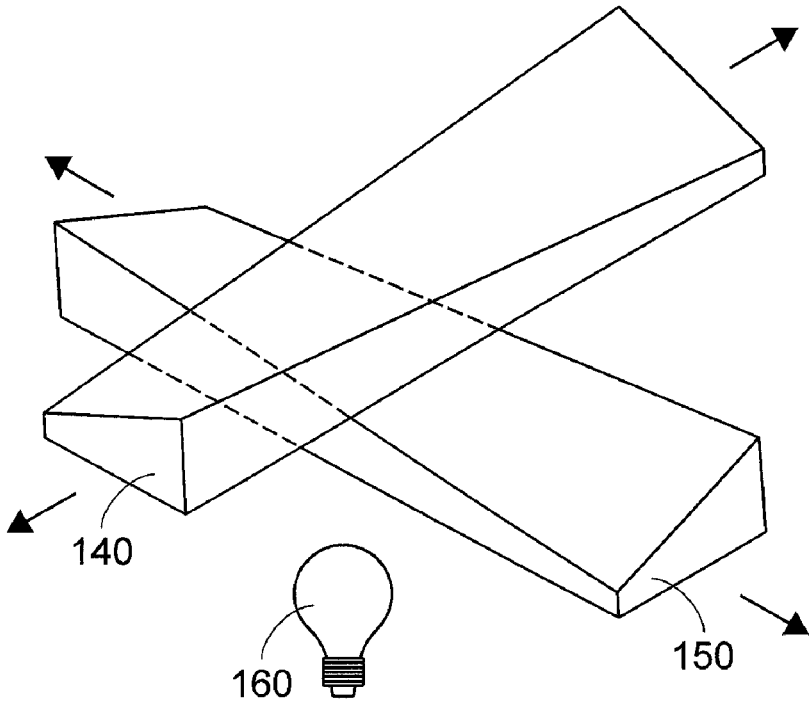
FIG. 7 is a schematic perspective view illustrating a lighting device according to a first preferred embodiment of the present invention.

FIG. 7 is a schematic perspective view illustrating a lighting device according to a first preferred embodiment of the present invention. The lighting device principally comprises a light source 160, two beam-directing prism elements 140 and 150 in orthogonal arrangement, and a transmission device (not shown). The transmission device is connected to these two beam-directing prism elements 140 and 150. By the transmission device, the first beam-directing prism element 140 is horizontally moved and the second beam-directing prism element 150 is vertically moved. The first beam-directing prism element 140 has a downward directing region, a flat region and an upward directing region. The second beam-directing prism element 150 has a rightward directing region, a flat region and a leftward directing region.

The light source 160 can emit a light beam. After the lighting device is powered on, the light beam emitted by the light source is directed to the overlapping region of the first beam-directing prism element 140 and the second beam-directing prism element 150. In other words, by changing the position of the overlapping region corresponding to the position of the first beam-directing prism element 140 and the position of the second beam-directing prism element 150, the light beam emitted by the light source may pass through one of the downward directing region, the flat region and the upward directing region of the first beam-directing prism element 140 and one of the rightward directing region, the flat region and the leftward directing region of the second beam-directing prism element 150.

Since the beam-directing prism elements 140 and 150 have gradual slope variations on their surfaces, the bending angles are varied when the light beam are incident on different regions. By controlling the transmission device to adjust relative locations of the first beam-directing prism element 140 and the second beam-directing prism element 150, the light beam emitted by the light source 160 may pass through different regions of the prism elements 140 and 150. Since the light beams emitted by the light source 160 are simultaneously diffracted by the prism elements 140 and 150, the resultant irradiation positions are adjustable in the two-dimensional coordinate system.

Figure 8A:
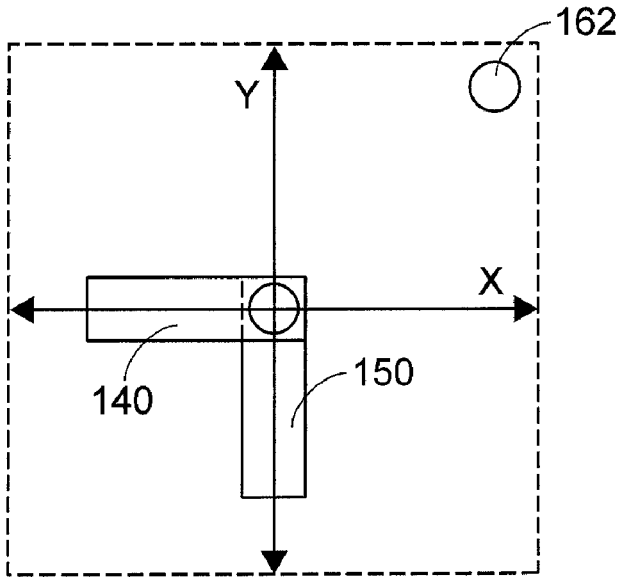
FIGS. 8A and 8B schematically illustrate two irradiation positions generated by the lighting device of the present invention.
Figure 8B:
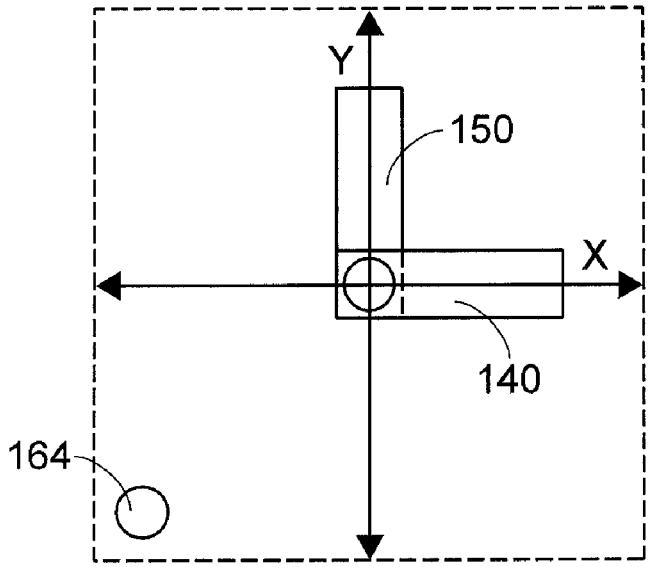

FIGS. 8A and 8B schematically illustrate two irradiation positions generated by the lighting device of the present invention. In the drawings, the horizontal axis is labeled X, and the vertical axis is labeled Y. The first beam-directing prism element 140 is arranged along the X-axis and the second beam-directing prism element 150 is arranged along the Y-axis. The light source 160 is located at the origin of the X-Y coordinate and emits the light beam out of the paper. In a case that the light beam emitted by the light source 160 passes through the upward directing region of the first beam-directing prism element 140 and the rightward directing region of the second beam-directing prism element 150, as shown in FIG. 8A, therefore, the diffracted light beam is projected on an irradiation position 162 in the first quadrant. In a case that the light beam emitted by the light source 160 passes through the downward directing region of the first beam-directing prism element 140 and the leftward directing region of the second beam-directing prism element 150, as shown in FIG. 8B, therefore, the diffracted light beam is projected on an irradiation position 164 in the third quadrant. The rest will be deduced by analogy.

Figure 9:
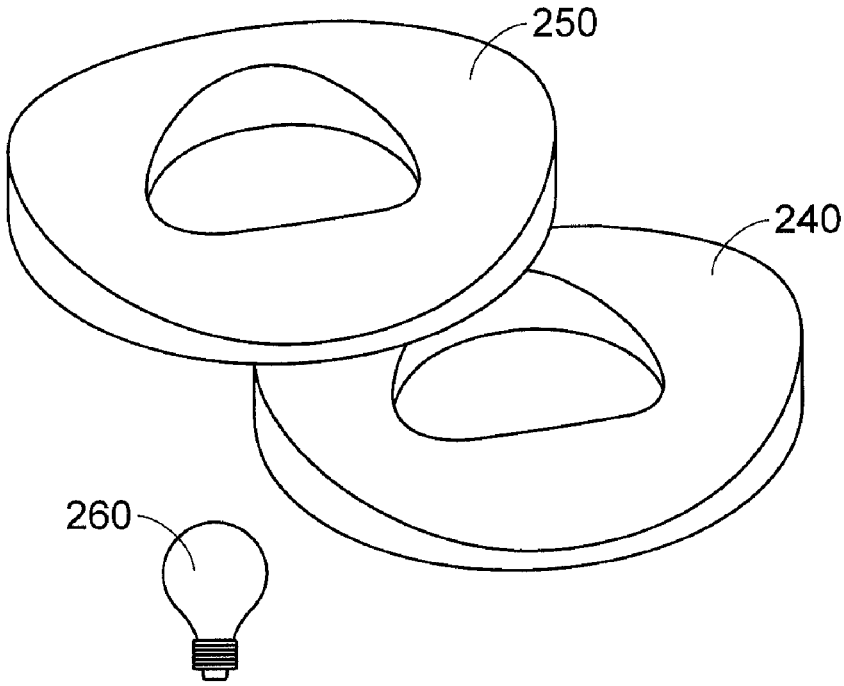
FIG. 9 is a schematic perspective view illustrating a lighting device according to a second preferred embodiment of the present invention.

FIG. 9 is a schematic perspective view illustrating a lighting device according to a second preferred embodiment of the present invention. The lighting device principally comprises a light source 260, two partially overlapped ring-shaped beam-directing prism elements 240 and 250, and a transmission device (not shown). The transmission device is connected to these two ring-shaped beam-directing prism elements 240 and 250. The transmission device is controlled to drive rotation of the two ring-shaped beam-directing prism elements 240 and 250. The first ring-shaped beam-directing prism element 240 has a downward directing region, a flat region and an upward directing region. The second ring-shaped beam-directing prism element 250 has a rightward directing region, a flat region and a leftward directing region.

The light source 260 can emit a light beam. After the lighting device is powered on, the light beam emitted by the light source is directed to the overlapping region of the first ring-shaped beam-directing prism element 240 and the second ring-shaped beam-directing prism element 250. In other words, by changing the position of the overlapping region corresponding to the position of the first ring-shaped beam-directing prism element 240 and the position of the second ring-shaped beam-directing prism element 250, the light beam emitted by the light source may pass through one of the downward directing region, the flat region and the upward directing region of the first ring-shape beam-directing prism element 240 and one of the rightward directing region, the flat region and the leftward directing region of the second ring-shaped beam-directing prism element 250.

Since the ring-shaped beam-directing prism elements 240 and 250 have gradual slope variations on their surfaces, the bending angles are varied when the light beams are incident on different regions. By controlling the transmission device to continuously adjust relative locations of the ring-shaped beam-directing prism elements 240 and 250, the light beam emitted by the light source may pass through different regions of the ring-shaped prism elements 240 and 250. Since the light beams emitted by the light source are simultaneously diffracted by the ring-shaped prism elements 240 and 250, the resultant irradiation positions are adjustable in the two-dimensional coordinate system.

From the above description, the lighting device of the present invention is capable of adjusting the irradiation position by using specific ring-shaped prism elements to diffract the light beams. By controlling the transmission device to adjust relative locations of the beam-directing prism elements, the light beam emitted by the light source may be directed to a desired position. If the relative locations of the beam-directing prism elements are continuously adjusted, continuous illumination variations are rendered.

While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A lighting device comprising:

a light source for emitting a light beam;

a first beam-directing prism element arranged in a first direction, wherein different bending angles are resulted when the light beam passes through different regions of the first beam-directing prism element; and a second beam-directing prism element arranged in a second direction and partially overlapped with the first beam-directing prism element, wherein different bending angles are resulted when the light beam passes through different regions of the second beam-directing prism element;

wherein the first beam-directing prism element is movable in the first direction, and the second beam-directing prism element is movable in the second direction;

wherein the light beam emitted by the light source simultaneously passes through one of the regions of the first beam-directing prism element and one of the regions of the second beam-directing prism element.

2. The lighting device according to claim 1 wherein the first beam-directing prism element and the second beam-directing prism element are made of transparent material such as polymethylmethacrylate (PMMA) or polycarbonate (PC).

3. The lighting device according to claim 1 wherein each of the first beam-directing prism element and the second beam-directing prism element has a surface with gradual slope variations.

4. The lighting device according to claim 1 wherein each of the first beam-directing prism element and the second beam-directing prism element has two surfaces with gradual slope variations.

5. The lighting device according to claim 1 wherein the first beam-directing prism element and the second beam-directing prism element are orthogonal with each other, so that the resultant irradiation positions of the light beam are adjustable in the two-dimensional coordinate system.

6. The lighting device according to claim 1 wherein the first beam-directing prism element comprises a downward directing region, a flat region and an upward directing region.

7. The lighting device according to claim 1 wherein the second beam-directing prism element comprises a rightward directing region, a flat region and a leftward directing region.

8. A lighting device comprising:

a light source for emitting a light beam;

a first ring-shaped-directing prism element, wherein different bending angles are resulted when the light beam passes through different regions of the first ring-shaped-directing prism element; and a second ring-shaped-directing prism element partially overlapped with the first ring-shaped-directing prism element, wherein different bending angles are resulted when the light beam passes through different regions of the second ring-shaped-directing prism element;

wherein the first ring-shaped-directing prism element and second ring-shaped-directing prism element are rotatable, and the light beam emitted by the light source simultaneously passes through one of the regions of the first ring-shaped-directing prism element and one of the regions of the second ring-shaped-directing prism element.

9. The lighting device according to claim 8 wherein the first ring-shaped-directing prism element and the second ring-shaped-directing prism element are made of transparent material such as polymethylmethacrylate (PMMA) or polycarbonate (PC).

10. The lighting device according to claim 8 wherein each of the first ring-shaped beam-directing prism element and the second ring-shaped beam-directing prism element has a surface with gradual slope variations.

11. The lighting device according to claim 8 wherein each of the first ring-shaped beam-directing prism element and the second ring-shaped beam-directing prism element has two surfaces with gradual slope variations.

12. The lighting device according to claim 8 wherein the first ring-shaped beam-directing prism element comprises a downward directing region, a flat region and an upward directing region.

13. The lighting device according to claim 8 wherein the second ring-shaped beam-directing prism element comprises a rightward directing region, a flat region and a leftward directing region.

* * * * *